United States Patent [19]

Page

[11] 4,008,012

[45] Feb. 15, 1977

[54] DOUBLE-ACTING PUMP

[76] Inventor: Victor John Page, 47 Westmiston Avenue, Saltdean, Sussex, England

[22] Filed: July 7, 1975

[21] Appl. No.: 593,504

[30] Foreign Application Priority Data

July 9, 1974 United Kingdom ..... 30365/74

[52] U.S. Cl. ..... 417/454; 417/435

[51] Int. Cl.[2] ..... F04B 21/02; F04B 39/00

[58] Field of Search ..... 137/148, 149, 533.31; 417/454, 535, 536

[56] References Cited

UNITED STATES PATENTS

| | | | |
|---|---|---|---|
| 554,798 | 2/1896 | Rowland | 137/149 |
| 1,449,590 | 3/1923 | Dent | 137/533.31 |
| 2,146,709 | 2/1939 | Bird et al. | 137/533.31 |
| 2,217,287 | 10/1940 | McNew | 417/536 |
| 2,733,664 | 2/1956 | Saalfrank | 417/454 |
| 3,142,257 | 7/1964 | Schudt | 417/454 |
| 3,849,033 | 11/1974 | Schau | 417/454 |

FOREIGN PATENTS OR APPLICATIONS

| | | | |
|---|---|---|---|
| 224,025 | 10/1942 | Switzerland | 417/536 |

*Primary Examiner*—William L. Freeh
*Attorney, Agent, or Firm*—Steele & Petock

[57] ABSTRACT

A double-acting pump for food products. The pump has a metering cylinder closed by end caps defining respective pairs of inlet and outlet parts. Valve housings contain identical valves and are connected to respective manifolds. The components are maintained in sealing relationship by urging the end caps together. A locking collar and drain plate enables pump to be bodily rotated through 180° without releasing clamping force, for self draining and cleansing-in-place. Pump can be dismantled without tools.

4 Claims, 8 Drawing Figures

DOUBLE-ACTING PUMP

FIELD OF INVENTION

Figure 1:
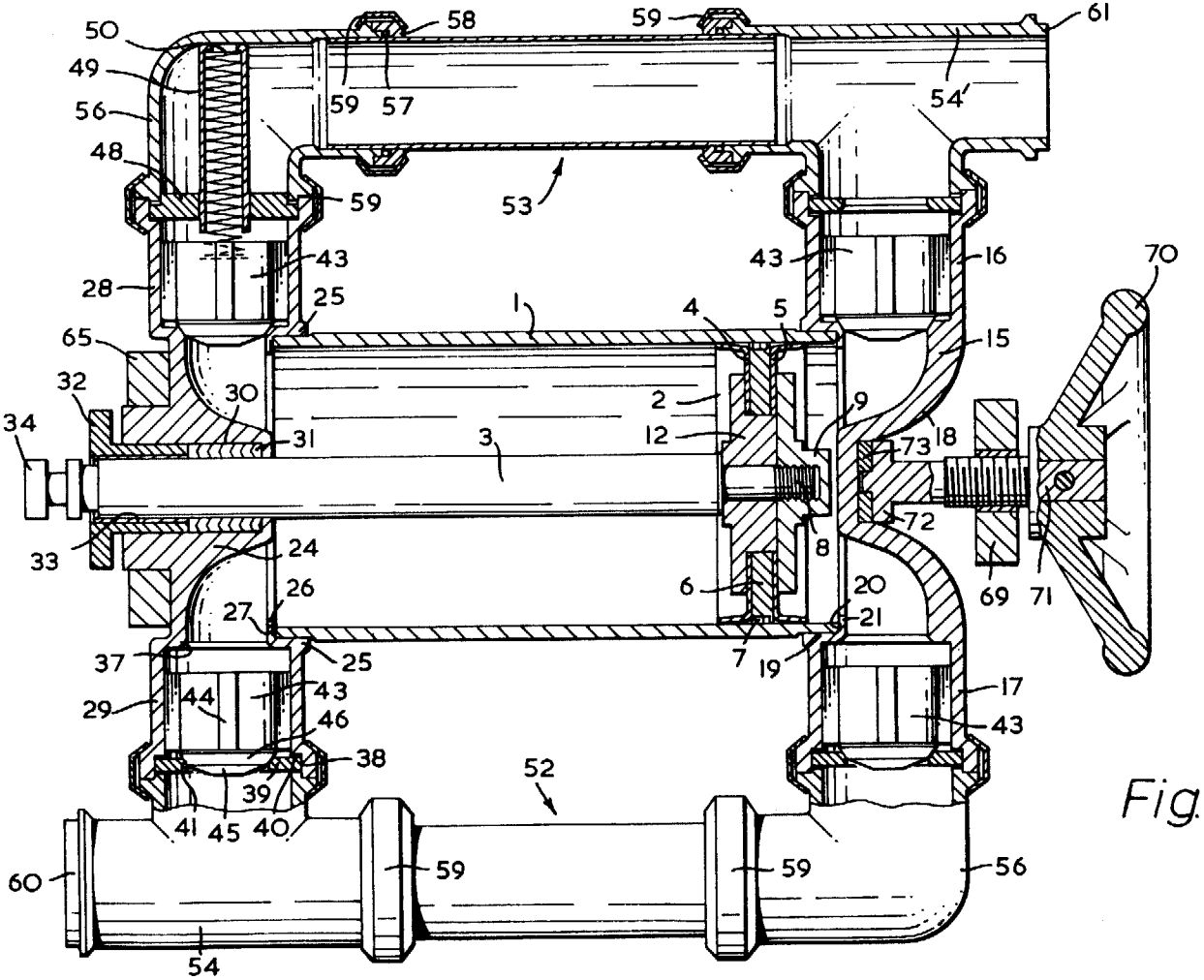

This invention relates to double-acting pumps. Pumps in accordance with the invention are particularly useful in the food industry for delivering accurately metered quantities of food into receptacles such as plastic cartons.

PRIOR ART

In the food industry, it is highly desirable to provide apparatus which accurately and repeatedly dispenses a predetermined quantity of food having the consistency of a liquid, a cream or a paste, or even solids in a liquid such as pieces of meat in gravy or vegetables in water. It is essential, for reasons of hygene, that the apparatus be such that it can be thoroughly cleaned and sterilised. This means that it can be cleaned-in-place and/or easily dismantlible. Moreover, ease of servicing is highly desirable for both general maintenance and for the ability to modify the apparatus to suit different products. One of the factors which contribute to the cost of packaging food is known as the "up-and-down" time namely, the time required for cleaning and servicing the food dispensing apparatus and/or modifying it to suit the product dispensed. Thus the ease of servicing is of great importance.

OBJECTS OF INVENTION

An object of this invention is to provide a double-acting pump for accurately and repeatedly dispensing accurate quantities of food, which pump can be cleaned-in-place and rapidly dismantled for servicing and/or further cleaning.

Another object of this invention is to provide a double-acting pump which is self-draining.

A further object of this invention is to provide a double-acting pump in which the life of comressible seals between releasable parts is lengthened.

It is also an object of this invention to provide a double-acting pump which can be quickly dismantled without the use of tools.

SUMMARY OF INVENTION

According to the invention, a double-acting pump comprises a metering cylinder housing a piston which is normally coupled to means for imparting a reciprocal motion thereto. A pair of end caps are removably fitted to respective ends of the metering cylinder. A pair of valve housings fitted to each end cap define respective inlet and outlet ports at each end of the cylinder. The inlet and outlet port of each end cap are preferably diametrically opposed to promote a self-draining action in the pump as further explained. A non-return valve is fitted in each valve housing, the valves preferably being identical and having a fluted body with a dome-shaped valve face. Inlet and outlet manifolds are fitted to the respective valve housings, each manifold comprising a sleeve, a tubular bend and a tubular tee which are removably connected. Resilient sealing rings can be provided between the respective ends of the tubular bends, tubular tees and sleeves, which rings are compressed when the end caps are urged together. A backing plate is clamped between the first end cap and a locking collar which threadably engages a first one of said end caps. A draw-plate adjacent the other or second end cap is engaged by at least two tie rods supported by the backing plate. Means, such as a screw passing through the draw-plate and abutting the second end cap, are provided for exerting a force on the second end cap to draw the end caps together. The locking collar is releasable so that the pump can be bodily rotated about the axis of the metering cylinder witout releasing the force securing the end caps together and holding the respective components in sealing relationship with the metering cylinder. Thus any seals which have been compressed are unaffected by releasing the locking collar. The life of such seals is thereby extended when the pump is placed in a self-draining and flushing mode. For example, the attitude of the inlet and outlet valves is changed simply by rotating the pump bodily through 180°.

Each of said valve housings preferably comprises a removable insert defining an annular valve seat, an integral valve seat spaced from said insert and the non-return valve which is located between the insert and the integral valve seat. The integral seats are nearer the metering cylinder than the inserts, the outlet valves seating on the integral seats and the inlet valves on the inserts. When the non-return valves are identical, the inlet and outlet valves may be interchanged simply by inverting each valve in its housing.

The first end cap suitably houses a gland or bush for sealingly locating the pushrod. A bush may be retained in a recess in the first end cap by means of cir-clip so that the pushrod can be withdrawn to replace the bush.

For optimum sealing in the manifolds, the ends of each sleeve, tubular bend and tubular tee are provided with lands which taper in section from the exterior to the interior surfaces of the manifold. When the sealing rings provided between these parts are compressed, the edges of each ring more closely adjacent the interior of each manifold is compressed the most. The tubular bends and tees are preferably coupled to the respective valve housings and sleeves by quick release clamps so that the pump can be quickly dismantled without tools.

The invention will become more apparent with reference to the following description of preferred embodiments taken in conjunction with the accompanying drawings:

DESCRIPTION OF DRAWINGS AND PREFERRED EMBODIMENTS

Figure 2:
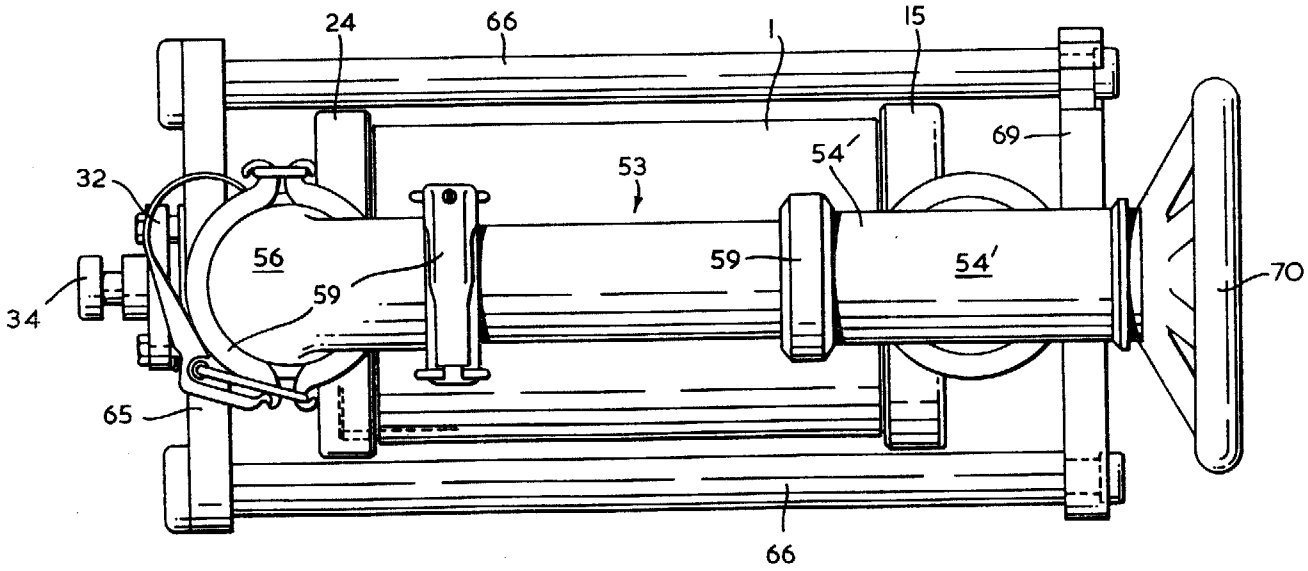
Figure 3:
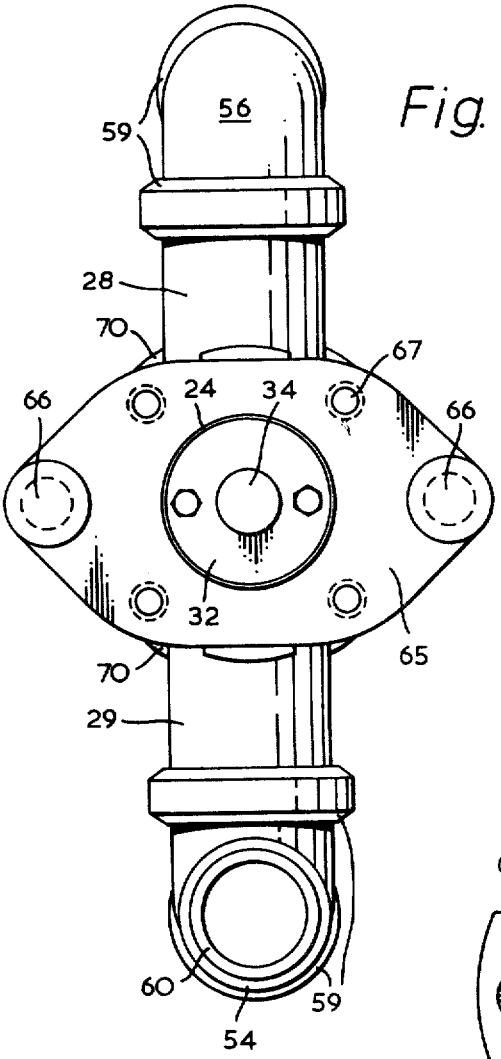
Figure 4:
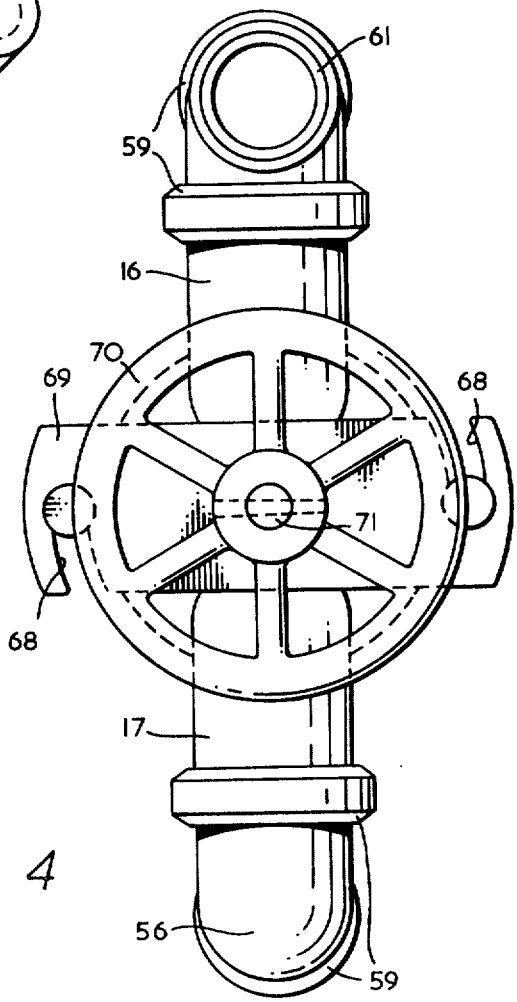
Figure 5:
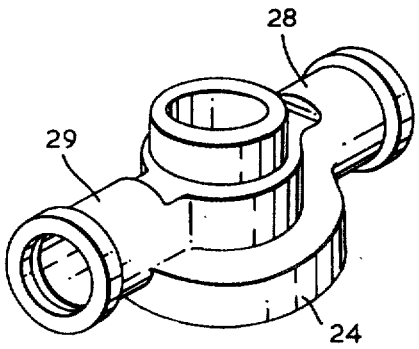
Figure 6:
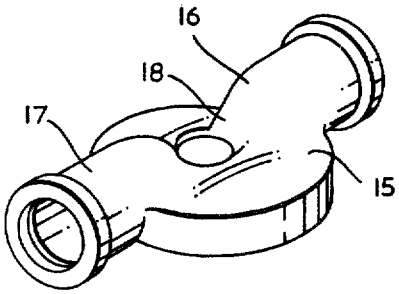
Figure 7:
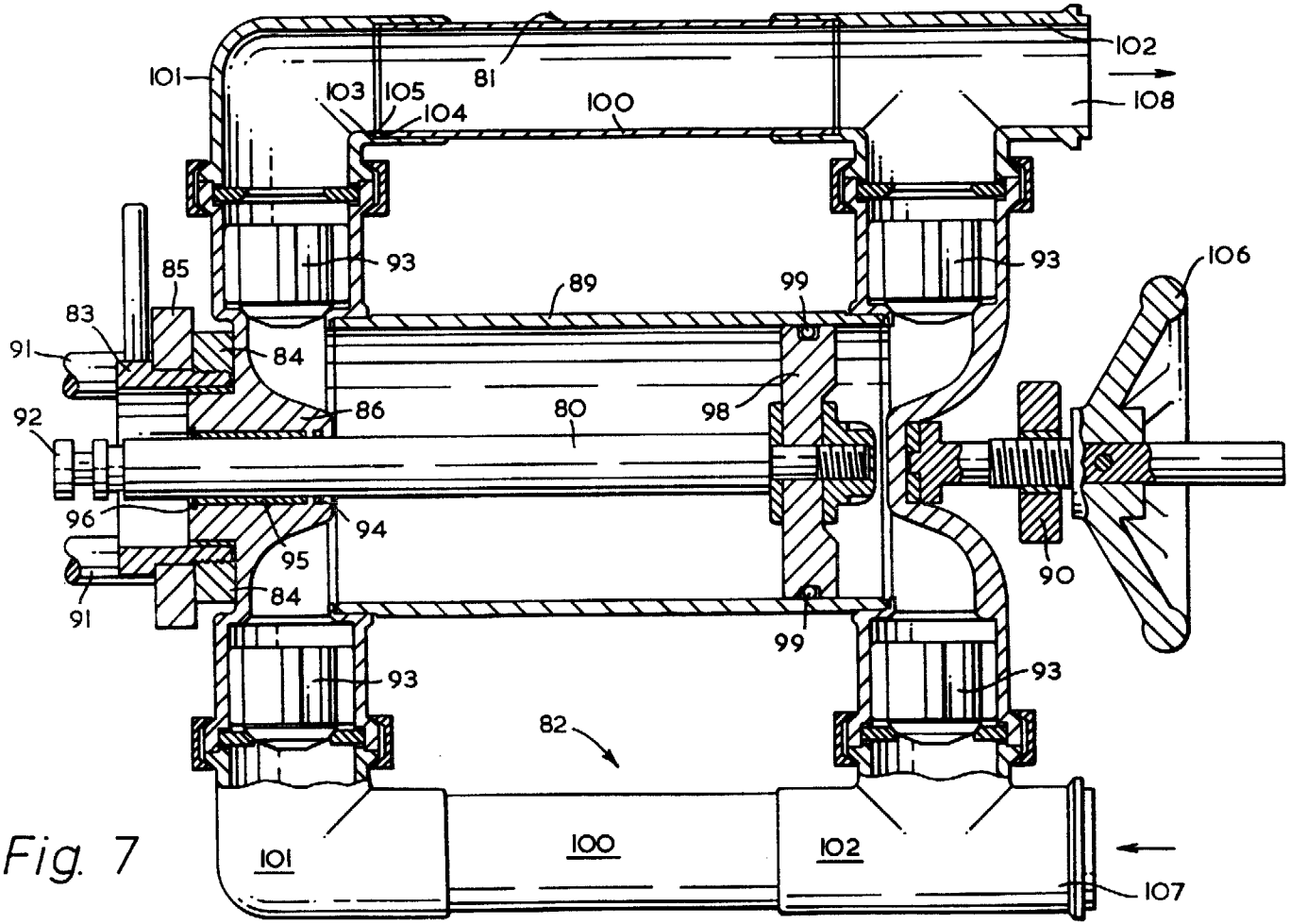
Figure 8:
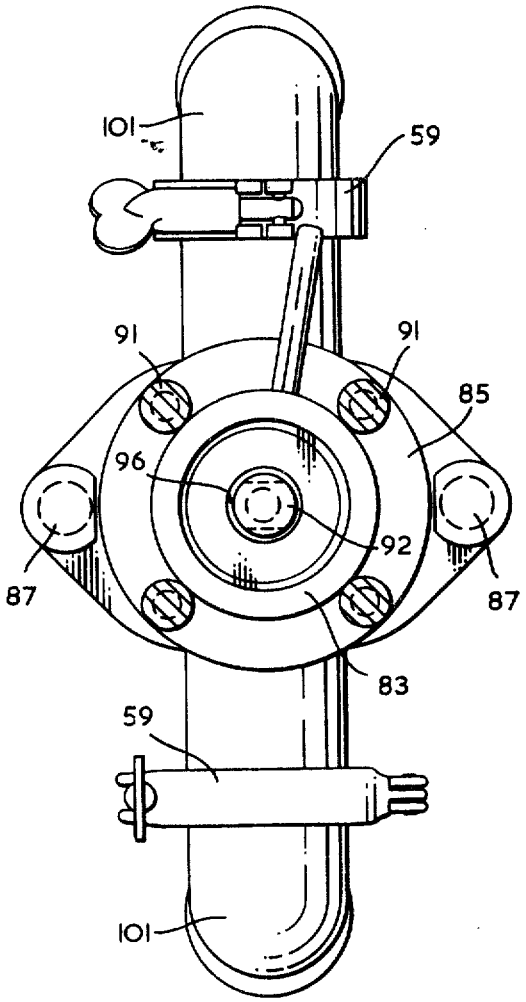

FIG. 1 is a sectional view through a double-acting pump according to a first embodiment of the invention, FIG. 2 is a top-plan view of the double-acting pump which is shown in FIG. 1, FIG. 3 is an elevation from one end of the pump of FIG. 1, FIG. 4 is an elevation from the other end of the pump of FIG. 1, FIGS. 5 and 6 respectively show perspective views of end caps used in the pump of FIG. 1, FIG. 7 is a sectional view through a pump according to a second embodiment, and FIG. 8 is an end elevation of the pump shown in FIG. 7.

Referring to FIGS. 1–6, a double acting pump comprises a metering cylinder 1 of circular cross section which houses a piston 2 attached to a push rod 3. The piston 2 comprises a pair of dished cups 4, 5 which are secured back-to-back in abutting relationship with an annular plate 6 which has peripheral annular recess to accommodate pair of piston rings 7. The leading end 8 of the push rod 3 threadably engages a recess in an end plate 9. A shoulder 10 is machined in the push rod 3, the shoulder having a peripheral recess accommodating an PTFE seal 11 which provides a seal between the shoulder 10 and a clamping plate 12. The annular recess in which the seal 11 is accommodated, tapers in a radial outward direction whereby the edge of the seal 11 is compressed the most when the end plate 9 is screwed on the end 8 of the push rod 3.

At the end of its stroke (as shown in FIG. 1) the piston 2 is adjacent an end cap 15, which end cap is integral with diametically opposed valve housings 16, 17 (FIGS. 1 and 6). The end cap 15 defines a recess 18 (the purpose of which will be explained below) and a shouldered annular recess 19, to receive the respective end of the metering cylinder 1. An annular seal 20 is provided in a recess in a radial lip 21 to provide sealing engagement between the end of the cylinder 1 and the end cap 15 when urged together.

Another end cap 24 is provided at the other end of the cylinder 1, which end cap similarly defines a shouldered recess 25, a radial lip 26 and an annular seal 27 located in a recessed inlet 26. End cap 24 is similarly integral with valve housings 28, 29 (FIGS. 1 and 5). It also defines a gland housing 30 which accommodates chevron glands 31 and a gland nut 32. A sleeve 33, of low-friction material is located between the gland nut 32 and the push rod 3. The push rod 3 is slidably supported by the gland, one end 34 of the push rod extending from the end cap 24 and being adapted for attachment to a reciprocating drive (not shown).

Taking valve housing 29 as an example, each valve housing can be similarly constructed despite the modification shown adjacent valve housing 28. Referring to valve housings 29, it has an integral frusto-conical valve seat 37, and an annular recess 38 which accommodates a removable insert 39 located between a pair of annular seals 40. Insert 39 defines an frusto-conical valve seat 41.

A valve 43, shown in valve housing 29, is typical of the four valves illustrated. Each valve 43 has a fluted body, the flutes being defined by axial ribs 44. The head 45 of the body is dome-shaped and defines a spherical valve face 46.

In valve housings 17 and 29, the valve faces seat on the removable inserts 39. In valve housings 16 and 28, the valves sent on the integral valve faces 37. When the valves are driven away from their closure seats, their movement is limited either by the walls defining the integral valve seats 37 (housings 19, 29) or the removable inserts (housing 16, 28).

If necessary, the outlet valves 43 in housings 16, 28, may be spring biased to assist their return. Such spring biasing is illustrated adjacent housing 28. In this case, the removable insert 39 is replaced by an insert 48 which has radially disposed holes through the insert and supports a spring housing 49 accomodating a return spring 50. One end of the spring 50 is located in a recess in the body of valve 43.

Valve housings 19, 29 are connected to an inlet manifold 52 and valve housings 16, 28 to an outlet manifold 53. These manifolds are of similar construction and consist of a tubular 'T' 54, a sleeve 55 and a tubular elbow 56. The main stem of T 54 and one arm of the tubular elbow 56 are adapted to seat on the resilient annular seals 40 adjacent the removably inserts 41 in each valve housing. Sleeve 55 is located within the confronting limbs of the T 54 and elbow 56 and is sealed therein by means of O-rings 57 which are compressed by a backing ring 58 when a quick release clamp 59 is tightened. The construction of a typical quick release clamp 59 is best seen in FIG. 8.

The inlet of the manifold 52 is defined by the open limb 60 of T and the outlet of the manifold 53 is defined by the open limb 61 of T 54'.

Referring now to FIGS. 1–4, a backing plate 65 supports two tie rods 66 passing axially alongside the body of the cylinder 1. Backing plate 65 is secured to reciprocating drive means with four screws 67 secured to tie rods (not shown). The tie rods 66 are located in arcuate slots 68 in a draw plate 69. Slots 68 face in opposite directions whereby plate 69 may be disengaged from the tie rods by clockwise rotation (as seen in FIG. 4). Hand wheel 70 is fitted to a screw threaded shaft 71, threadably located in draw plate 69. The end of the shaft 71 terminates in a plate 72 which abuts a thrust pad of anti-friction material 73 between it and the floor of the recess 18 in the end cap 15. When the hand wheel 70 is tightened, shaft 71 is urged towards end cap 15 whereby the tie rods 66 are tensioned. The end caps 15, 24 are thus drawn together and sealingly engage the cylinder 1.

The mode of operation of the pump of FIG. 1 will now be described.

When the push rod 3 is withdrawn from end cap 24 and the piston 2 moves to the left of cylinder 1 (as seen in FIG. 1) a charge enters the cylinder through manifold 55 and valve housing 17. On this induction stroke valve 43, in housing 16, is closed. When the push rod 3 is urged back inside the cylinder 1, the piston 2 forces the charge from the metering cylinder through housing 16 and out from manifold 53; valve 43 (housing 17) is closed during this exhaust stroke. Similarly, the valves 43 in housings 28, 29 open and close to admit a charge from manifold 52 when the piston 2 moves to the right of the drawing, and to expel the charge through housing 28 and manifold 53 when the piston 2 moves to the left of the drawing. It will therefore been seen that the pump is double acting since one charge is drawn in and another expelled on each stroke of the piston 2.

The pump can be cleaned-in-place by passing a flushing medium from inlet 60 to outlet 61.

Referring now to FIGS. 7 and 8, the double acting pump illustrated therein is adapted for self-draining as will be explained below. The pump has basically the same construction and mode of operation as the pump described above with reference to FIGS. 1–6. However, certain detailed differences of construction will now be described.

The pump shown in FIG. 7 can be bodily rotated about an axis 80 whereby the positions of the outlet manifold 81 and the inlet manifold 82 are interchanged. This is achieved by providing a locking collar 83 which threadably engages a tie rod supporting plate 84 adjacent end cap 86 of the pump. Another tie rod end plate 85 is clamped between the collar 83 and plate 84 when the collar 83 is tightened. Tie rods 87, secured in plate 84, pass axially alongside a metering cylinder 89 and are secured in a draw plate 90 in the manner shown in FIG. 4. Tie rods 91 fitted to plate 85 support the pump adjacent a reciprocating drive which is attached to the end of a push rod 92.

When the locking collar 83 is released, the pump can be turned bodily through 180° without releasing the tension on tie rods 87 which hold the component parts of the pump together. When so rotated, valves 93 fall away from their valve seats (the pump normally being vertically orientated as shown in FIG. 7), whereby the pump becomes self-draining.

Instead of using a gland, as in the pump of FIG. 1, end cap 86 houses an O-ring 94 and a PTFE sleeve bearing 95 which is held in position by means of a cir-clip 96. In this case, when the tension is released on the tie rods in order to dismantle the pump, the cylinder 89 is removed in order to extract the push rod 92 to replace the sleeve bearing 95.

Cylinder 89 houses a piston 98 which is of a simpler construction than the piston 2 as shown in the embodiment of FIG. 1. In this case, a single O-ring 99 seals the piston against the cylinder wall.

It will be seen that the straight portion of each manifold 81, 82 has a smoother more continuous surface than that in the manifolds 52, 53 of the pump in FIG. 1. Moreover, each manifold includes a sleeve 100 which is inserted in the confronting limbs of an elbow 101 and a T 102. Confronting edges or lands 103, 104 of the recesses of the elbow or T and the ends of the sleeve respectively, define a trapezoidal cross-section, as seen in the Figure, to accommodate an annular seal 105. Thus, when hand wheel 106 is tightened, a greater sealing pressure is exerted on that face of each annular seal 105 which is part of an interior surface of the respective manifold.

It will be appreciated that the inlet 107 and the outlet 108 of the pump shown in FIG. 7 are at the same end of the pump whereby the pump can be rotated in order to connect the inlet 107 to an external outlet pipe and vice-versa.

What is claimed is:

1. A double-acting pump comprising:

a metering cylinder, a piston in the metering cylinder, a pushrod attached to the piston, a first end cap removably fitted at one end of the metering cylinder, said first end cap containing an annular seal which supports the pushrod for reciprocal movement therein, a second end cap removably fitted at the other end of the cylinder, a pair of valve housings fitted to each one of said end caps, each valve housing in said pair defining either an inlet or an outlet port to said cylinder, a non-return valve located in each valve housing, each valve being supported in its housing between an annular seating and an annular stop, said seating and said stop communicating directly with the respective port and manifold whereby material, moved by said piston, is caused to flow past said valve, the external surface of the valve between portions engaging said seating and said stop being fluted so as to enable passage of material past said fluted surface while slidably engaging the internal wall of the valve housing, an outlet manifold removably fitted to the valve housings which define the outlet ports, an inlet manifold removably fitted to the valve housings which define the inlet ports, each of said manifolds comprising a sleeve, a tubular bend and a tubular tee, said tubular bend and said tubular tee of said manifolds being removably connected to the respective housings, a first backing plate clamped adjacent said first end cap, a draw plate adjacent said second end cap, at least two tie rods connected between said first backing plate and said draw plate, a second backing plate adjacent said first backing plate, said second backing plate being provided for connection to fixed supporting means for said pump, means connected to said draw plate for exerting a force on said second end cap whereby said end caps are drawn together, and a locking collar adjacent said second backing plate and threadably engaging said first backing plate, said collar being movable on said treaded engagement either to exert a clamping force on said first and second backing plates to hold said pump fast, or to release said clamping force whereby said pump can be bodily rotated about the axis of the metering cylinder without releasing the force securing the end caps and the metering cylinder in sealing relationship, the valve housing in each pair of said valve housings being located diametrically opposite the other valve housing across the diameter of said cylinder, whereby the attitude of the inlet and outlet valves in the valve housings can be changed by turning the pump bodily through 180° about said axis of the metering cylinder for draining said pump.

2. The pump according to claim 1 wherein each of said valve housings includes a removable insert defining an annular valve seat, which insert acts as either a stop or a valve seat according to the attitude of the valve fitted in the housing; an integral valve seat also being formed in said first and second end caps, to act as a valve seat or stop for said valve according to its attitude whereby the function of the valves can be reversed by inverting the valves whereupon the function of the inlet and outlet manifolds is also reversed.

3. The pump according to claim 2 wherein all of said valves are identical and have a fluted body with a dome-shaped valve face.

4. The pump according to claim 3 wherein resilient sealing rings are provided between the respective ends of the sleeve, tubular bend and tubular tee of each of said manifolds, said tubular elbows and said tubular tees being coupled to the respective valve housings and sleeves by quick-release clamps.

* * * * *